United States Patent [19]

Ikezaki et al.

[11] Patent Number: 4,617,034

[45] **Date of Patent: * Oct. 14, 1986**

[54] ELECTRIC CLEANER WITH MINIMUM NOISE

[75] Inventors: Katsuji Ikezaki, Sakai; Kiyoshi Ishii, Nishinomiya, both of Japan

[73] Assignee: Sharp Kabushiki Kaisha, Osaka, Japan

[ * ] Notice: The portion of the term of this patent subsequent to Aug. 6, 2002 has been disclaimed.

[21] Appl. No.: 697,012

[22] Filed: Jan. 31, 1985

Related U.S. Application Data

[63] Continuation of Ser. No. 478,328, Mar. 24, 1983, Pat. No. 4,533,370.

[30] Foreign Application Priority Data

| | | | |
|---|---|---|---|
| Mar. 30, 1982 | [JP] | Japan | 57-53553 |
| Apr. 8, 1982 | [JP] | Japan | 57-59436 |
| Apr. 8, 1982 | [JP] | Japan | 57-59437 |
| Apr. 8, 1982 | [JP] | Japan | 57-59438 |

[51] Int. Cl.[4] ..... B01D 46/00

[52] U.S. Cl. ..... 55/276; 55/372; 55/DIG. 3; 15/326

[58] Field of Search ..... 15/326; 55/276, 372, 55/373, 472, DIG. 3

[56] References Cited

U.S. PATENT DOCUMENTS

| | | | |
|---|---|---|---|
| 2,198,568 | 4/1940 | Yonkers | 55/276 |
| 2,672,949 | 3/1954 | Hage | 55/472 |
| 3,964,888 | 6/1976 | Hahner et al. | 55/276 X |
| 4,050,913 | 9/1977 | Roach | 55/276 |
| 4,356,591 | 11/1982 | Lude | 15/326 |

*Primary Examiner*—Charles Hart

*Attorney, Agent, or Firm*—Birch, Stewart, Kolasch & Birch

[57] ABSTRACT

An electric cleaner incorporates an effective noise suppression arrangement for minimizing the noise generated by the exhaust from the electric air blower. The present invention provides an electric cleaner comprising an air rectifying duct installed on its external surfaces so that the exhaust from the electric air blower can smoothly and quietly pass through it, while the noise emitted by the exhaust can be significantly minimized throughout the vacuum cleaning operation even when using a compact cleaner.

10 Claims, 10 Drawing Figures

ELECTRIC CLEANER WITH MINIMUM NOISE

This application is a continuation of copending application Ser. No. 478,328, filed on Mar. 24, 1983, now U.S. Pat. No. 4,533,370.

BACKGROUND OF THE INVENTION

The present invention relates to an electric cleaner, more particularly, to a noise suppressor that minimizes the noise of the exhaust from the electric air blower.

Conventionally, in an electric cleaner of any kind, since it is designed so that the exhaust generated by the electric air blower is blown thereof out of the exhaust outlet on the rear surface of the electric cleaner, the length of the exhaust passage between the electric air blower and the exhaust outlet in the rear portion of the cleaner is too short, limiting the ability to decrease the noise of the exhaust by any of the existing noise suppression methods. Due to the recent trend towards smaller cleaners, the internal space available for noise suppression has become narrower, and as a result, it has been extremely difficult to minimize such operating noise from the cleaner.

OBJECT AND SUMMARY OF THE INVENTION

In the light of such existing defective noise suppression methods, the present invention aims at providing an electric cleaner capable of minimizing the noise generated by the electric air blower despite the compact designs of modern electric cleaners. The present invention is characterized in that the embodied electric cleaner is provided with a rectifying duct on its external surface so that the exhaust generated by the electric air blower can be blown out through said rectifying duct.

In an electric cleaner according to the present invention, since the air rectifying duct is provided on its external surface so that the exhaust generated by the internal electric air blower can be blown out through said duct, the length of the duct can be extended irrespective of the internal construction of the electric cleaner itself, and so that exhaust can effectively be rectified while flowing through the duct, minimizing the noise even in a very compact electric cleaner prevailing today. Such a rectifying duct composed of a selected elastic material is provided at least on both sides of the cleaner housing so that the air rectifying duct can concurrently serve as the shock absorbing bumper, and as a result, such a construction can eliminate the need for a separate bumper.

DETAILED DESCRIPTION OF THE INVENTION

Figure 1:
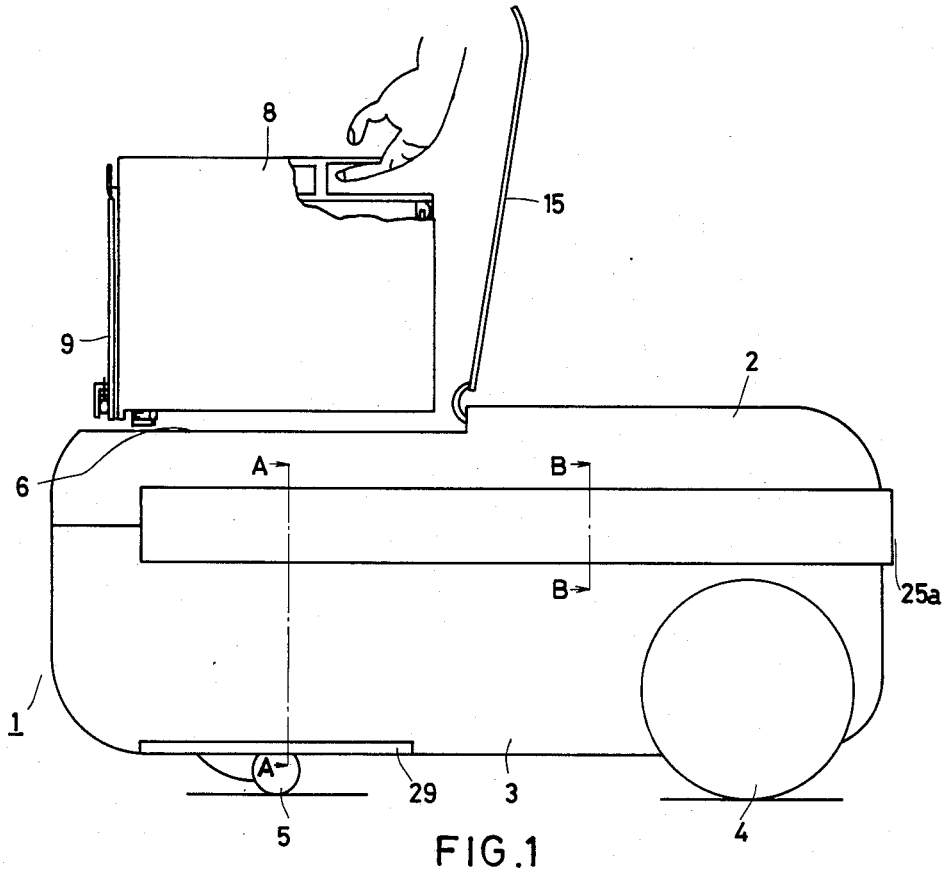
FIG. 1 shows a side view when the dust collector has been removed from the main body of the electric cleaner embodying the present invention.
Figure 2:
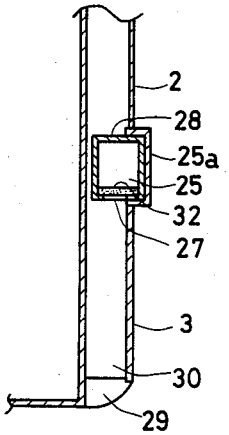
FIGS. 2 and 3 respectively show the sectional views of the portions A—A and B—B shown in FIG. 1.
Figure 3:
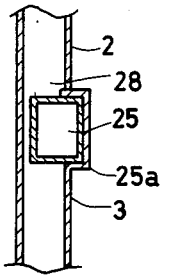
Figure 4:
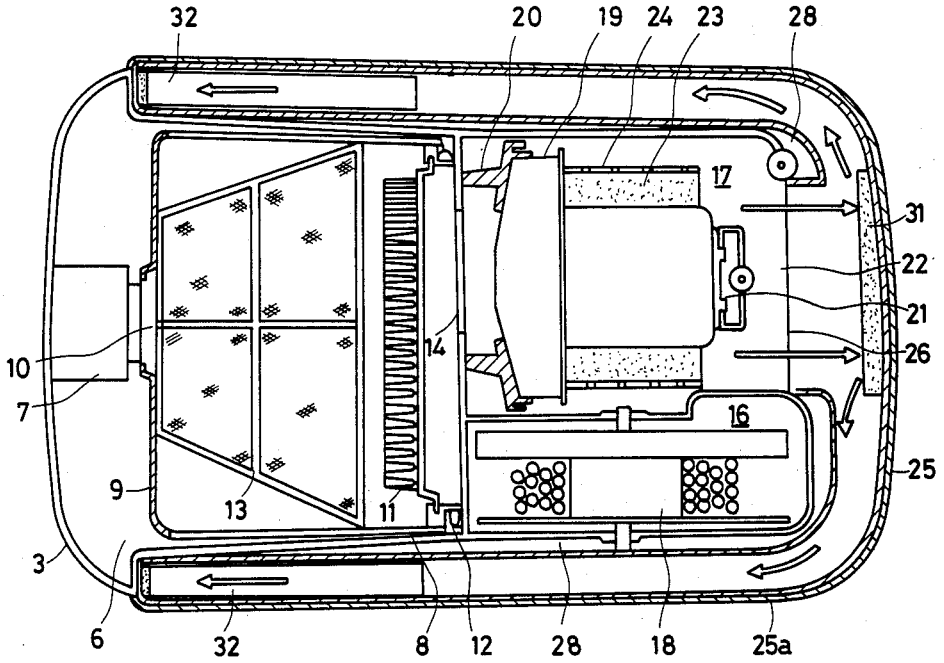
FIG. 4 shows a top view of an upper surface of the electric cleaner with its upper housing removed.
Figure 5:
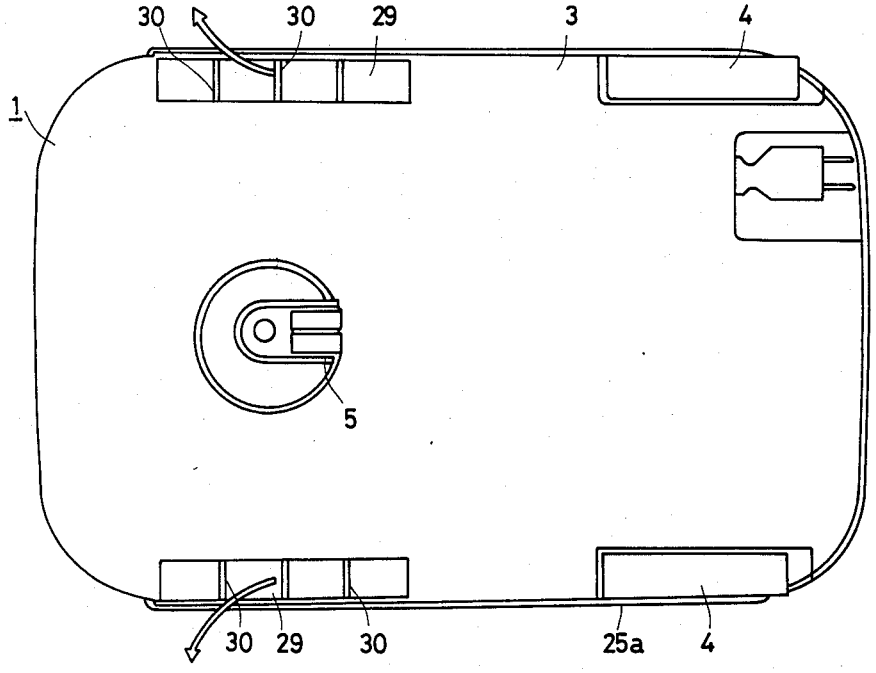
FIG. 5 shows a bottom view of the electric cleaner embodying the present invention.
Figure 6:
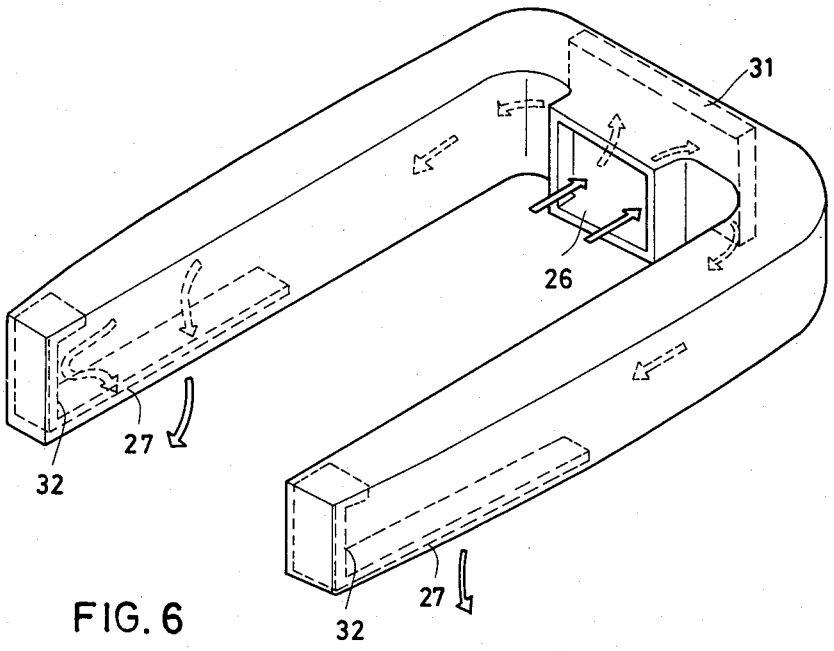
FIG. 6 shows a perspective view of the exhaust rectifying duct provided on both sides of the electric cleaner embodied by the present invention.

In reference to the drawings attached hereto, the preferred embodiments of the present invention are described below. As shown in FIGS. 1 through 6, the electric cleaner 1 according to the present invention is composed of the upper housing 2 and the lower housing 3, and in addition, it is provided with wheels 4 on both sides of the rear portion and also a pivotable universal wheel 5 on the bottom surface of the front portion. There is a chamber 6 in the front portion of the cleaner 1, having its opening at the upper surface. A suction duct 7 is provided in the front wall of said chamber 6 for connection to the vacuum hose (not illustrated). Said chamber 6 can contain a dust collection case 8 insertable and removable through the upper opening. Said dust collection case 8 has wide openings both in the front and rear ends. The front opening is provided with the front lid 9 having a dust inlet 10, while said front lid 9 can be freely opened or closed. The rear opening is provided with the main filter 11 which is secured to the gasket (packing) 12 around the circumference of said rear opening so that the air-tight condition can exist. A pre-filter 13 is inserted between the dust inlet 10 and the main filter 11. When the dust collection case 8 is loaded inside the cleaner housing 1, an air passage can be formed by the suction duct 7, dust inlet 10, prefilter 13, main filter 11, and the air intake 14 in the rear wall of the dust collector chamber 6. The upper opening of said chamber 6 can be opened and closed by the upper lid 15 of the cleaner housing 1.

The cleaner housing 1 is provided with a cord reel chamber 16 and an air blower chamber 17 in the left and the right portion behind the dust collector chamber 6. The cord reel chamber 16 stores a cord reel 18. The air blower chamber 17 is internally provided with vibration-proof rubbers 20 and 21 securing the electric air blower 19 so that the inlet port of the blower fan faces the air intake 14, whereas the exhaust port faces the exhaust outlet 22 on the rear surface of the cleaner housing 1. The external surface of the electric air blower motor 19 is provided with noise suppression material 24 such as polyurethane foam which is secured to a porous noise supression board made of rubber material.

The air rectifying duct 25 has a flat and U-shaped configuration, which is installed in such a way so that it extends from the rear surfaces up to positions near the foremost ends of both sides of the cleaner housing 1. The center of the air rectifying duct 25 exactly meets the exhaust outlet 22, thereby forming an air intake 26 that connects to the exhaust side of the electric air blower 19 through said exhaust outlet 22. The other exhaust outlets 27—27 can be formed in the bottom of the foremost ends of both sides. The air rectifying duct 25 is secured to the groove 28 on the external surface of the cleaner housing 1, while part of the outer surface of the air rectifying duct 25 is set so that it protrudes externally. In the preferred embodiment of the present invention, said air rectifying duct 25 is composed of elastic material, for example, made of low-forming polyvinyl chloride (PVC) resin such as polyurethane so that the air rectifying duct itself can be concurrently used as a shock absorbing bumper. In another preferred embodiment of the present invention, the surface of the protruded portion may be covered by a soft cover 25-*a* composed, for example, of the PVC resin, so that the air rectifying duct itself can be used as a shock absorbing bumper.

Said groove 28 is provided in a position between the upper and lower housings 2 and 3 so that it extends from the rear end surface up to positions near the foremost ends of both sides of the cleaner housing 1. A split exhaust outlet 29 contains a plurality of air rectifying ribs 30 and is provided in the bottom of the foremost ends of the cleaner housing 1, while said exhaust outlet 29 is extended up to the bottom surface of the cleaner housing 1, so that the position of said split exhaust outlet 29 correctly matches the exhaust outlet 27 of the air rectifying duct 25.

In the preferred embodiment incorporating a construction mentioned above, when the electric air blower 19 is operated, air containing a variety of dust and impurities is first sent to the dust collection case 8 through a dust suction unit, suction hose, dust intake unit 7, and suction gate 10. Rugged dust is caught by the prefilter 13 and then fine dust is thoroughly caught by the main filter 11 located in the dust collector case 8. The air free from dust is then sent to the electric air blower 19 through the ventilation duct 14, whereas all the impurities are deposited in the dust collection case 8. The exhaust from the electric air blower 19 then passes through the noise absorber 23 and the porous noise absorbing board 24, and then enters the air rectifying duct 25 through the exhaust outlet 22 and the air intake 26. The exhaust is routed to the left and right passages through the air rectifying duct 25 before being eventually discharged from the cleaner 1 through the exhaust outlets 27—27 and the split exhaust outlets 29—29. The air rectifying duct 25 is dimensionally long enough in order that the exhaust flow can effectively be rectified. As a result, the exhaust noise can be significantly attenuated in while simultaneously the air velocity is reduced since the exhaust flow is routed to several passages to the left and to the right simultaneously. The split exhaust outlet 29 effectively uses its rectifying ribs 30—30 to properly function. Through the combined effects of these, the total noise effect can be significantly minimized.

Figure 8:
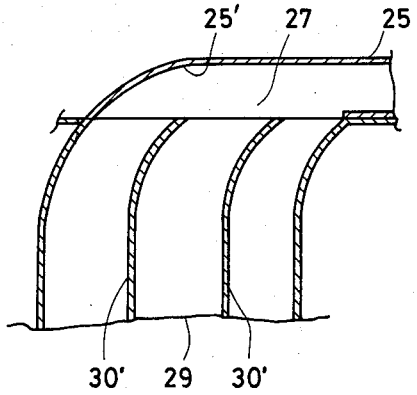
FIG. 8 shows another preferred embodiment of the present invention, showing a sectional view of the another air rectifying duct the present invention.
Figure 7:
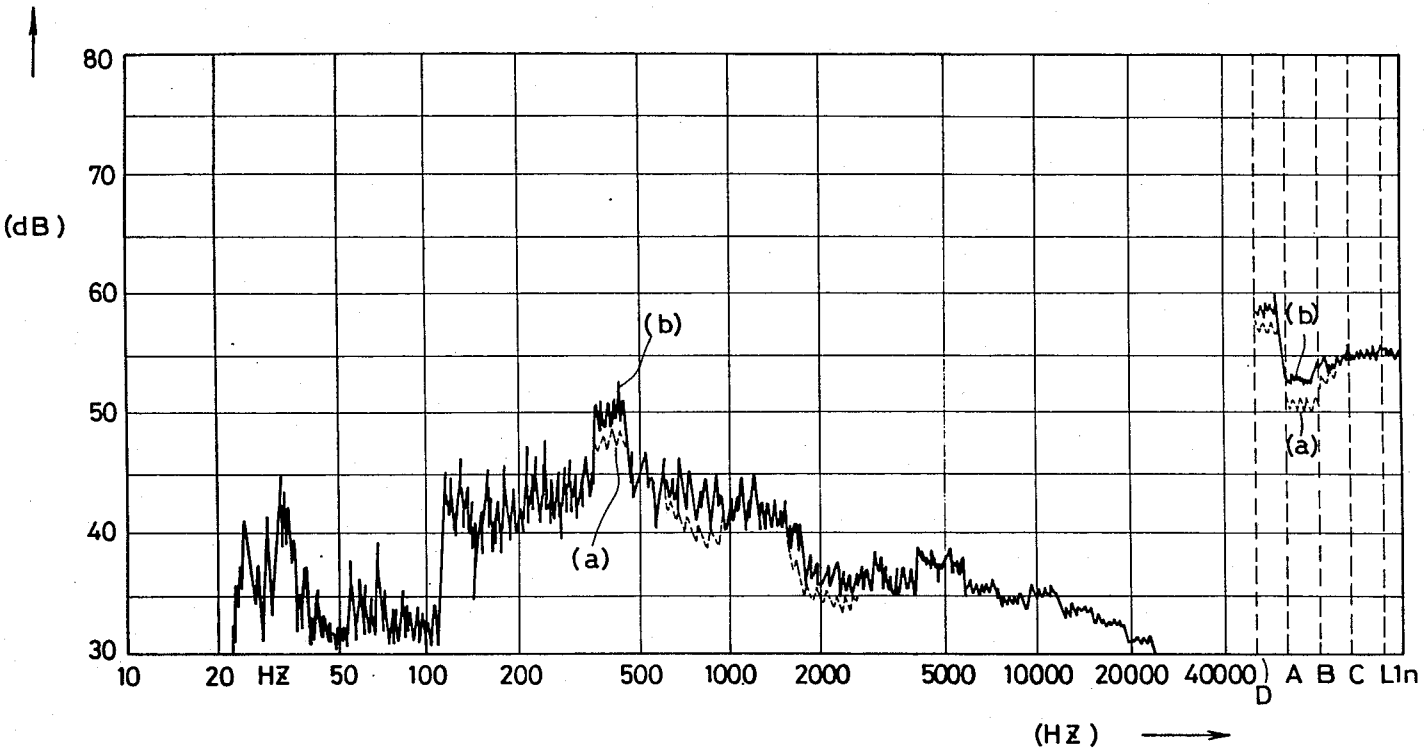
FIG. 7 shows the comparative graphic display of the actual magnitude of the noise with and without a soft cover provided for the electric cleaner.

Soft cover 25-*a* also partially shields and dampens the noise emitted by the air rectifying duct 25. As shown in FIG. 7, compared to the one devoid of such a soft cover 25-*a*, the cleaner with a soft cover 25-*a* minimizes the noise more effectively. FIG. 7 shows a comparative graphic display of the noise by testing with and without the soft cover 25-*a*. In the graph, (a) represents the noise level of using the soft cover 25-*a* set on the surface of the air rectifying duct 25 embodied by the present invention, whereas (b) represents the noise characteristics measured without using the soft cover 25-*a*. The soft cover 25-*a* concurrently prevents the furniture from being hit by the cleaner housing 1 during cleaning. FIG. 8 shows another preferred embodiment of the present invention, where the wall surface of one end portion of the exhaust outlet of the air rectifying duct 25 comprises a curved surface 25', while the other end portions of the air rectifying ribs 30—30 are also comprised of curved forms in the same way as the curved surface 25'. The curved construction of these changes the direction of the exhaust flow and effectively suppresses the noise.

The air rectifying duct 25 may be simply provided around the external surface of the cleaner housing 1. However, it is not always necessary that it extend outwardly around both side surfaces by from the rear surface of the cleaner housing 1. In the preferred embodiment of the present invention, the air rectifying duct 25 is set in the groove 28 of the cleaner housing 1 so that only part of its external surface slightly protrudes outwards. The air rectifying duct 25 need not necessarily protrude part of its external surface from the groove 28, or the duct structure itself may be entirely protruded outside the groove 28.

Referring to FIG. 6 again, the air rectifying duct 25 is internally and partially provided with noise absorber 31 and noise shielding material 32. The noise absorber 31 is composed, for example, of soft material such as soft-foamed polyurethane foam or felt, which is bonded at a position where the exhaust from the electric air blower 19 most fiercely impinges against it, and so it concurrently moderates and absorbs the noise of the fiercely hitting exhaust. The noise shielding material 32 is composed, for example, of porous material such as soft-foamed polyurethane foam, which is internally set in the foremost ends of the air rectifying duct 25 bent in the U-shape so that it extends up to the positions of the exhaust outlets 27—27 and across the front portion of the air rectifying duct 25, and as a result, the noise shielding material 32 can effectively dampen the noise externally emitted from the air rectifying duct 25 through the exhaust outlet 27 and also moderate the impact noise of the exhaust at the front portion of the air rectifying duct 25.

Figure 9:
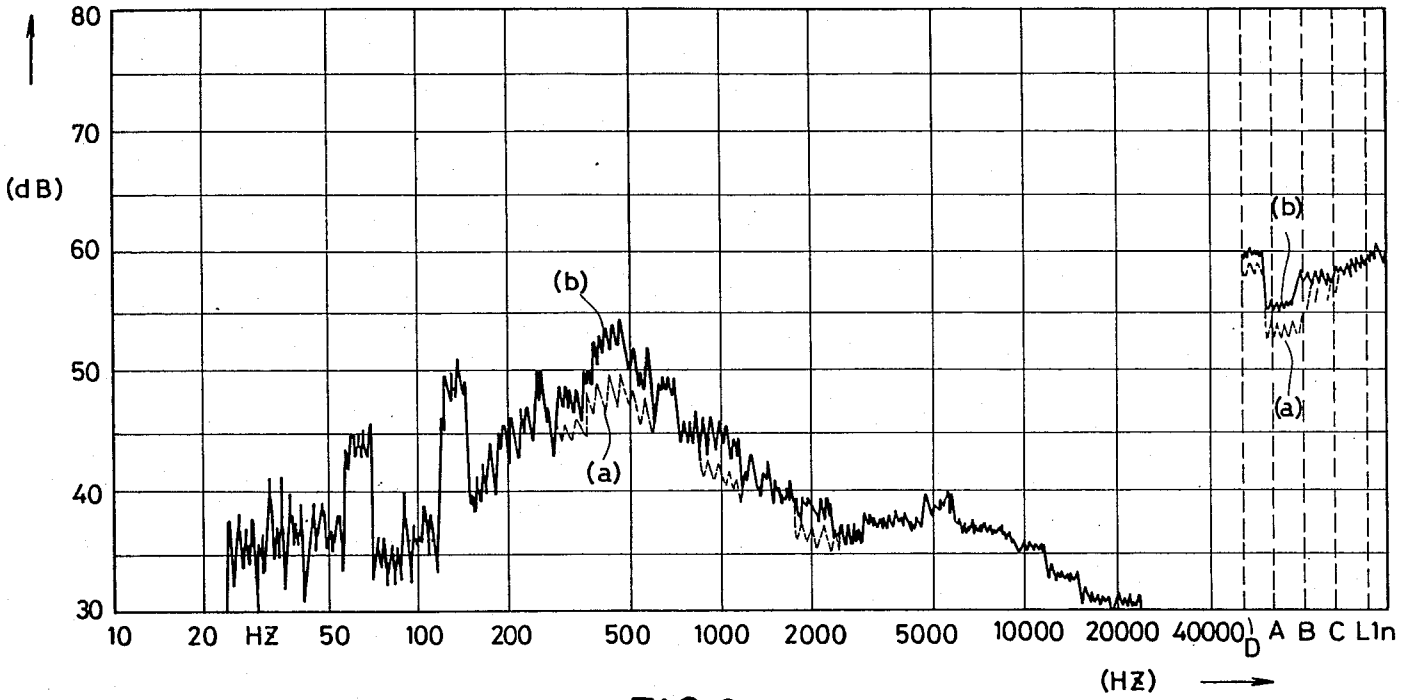
FIG. 9 shows the comparative graphic display of the actual magnitude of the noise with and without the noise absorbent and noise-proof materials applied.

In the above embodiment, although both the noise absorber 31 and noise shielding material 32 are locally provided, becuase of their ideal location in terms of the noise suppression effect, even the loudest noise emitted by the exhaust hitting against the internal part of the air rectifying duct 25 can be moderated, while the externally leaking noise from the air rectifying duct 25 can also be minimized significantly, as shown in the comprative noise characteristics of FIG. 9. FIG. 9 shows the comparative evaluation of the noise characteristics between two typical examples with and without the noise absorber 31 and the noise shielding material 32, where (a) represents the noise suppression effect of the device incorporating these, whereas (b) represents the noise characteristics without using any of them.

Figure 10:
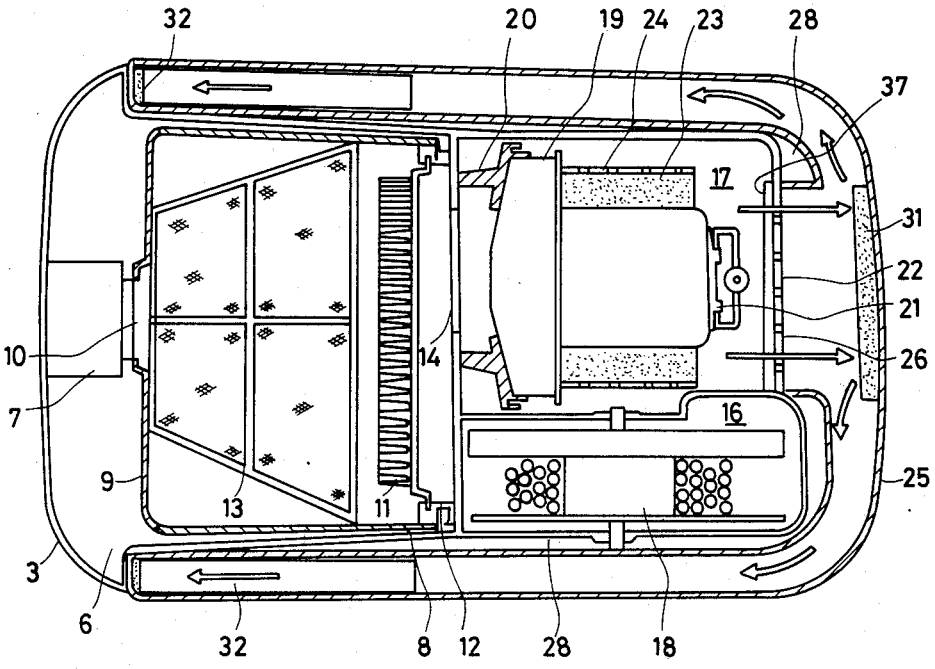
FIG. 10 shows a top view of another preferred embodiment of the present invention, where an upper surface of the electric cleaner with its upper housing removed is shown.

Referring to a still further embodiment of the present invention shown in FIG. 10, the relationship between the exhaust outlet 22 of the cleaner itself 1 and the air intake 26 of the air rectifying duct 25 is described below. The opening areas of both the exhaust outlet 22 and the air intake 26 are provided so that they are dimensionally greater than the sectional area of the passage of the air rectifying duct 25, while the noise shielding material 37, permeable to air, such as soft-foamed polyurethane foam, is provided inside the exhaust outlet 22. This is because the velocity of the exhaust flow is lower than the case when the exhaust flows through the air rectifying duct 25 having a smaller passage sectional area than the exhaust outlet 22 that has a relatively larger opening area, and so a very satisfactory noise suppression effect can be achieved. In addition, since the noise shielding material 37 is highly resistant to the impinging exhaust force and both the exhaust outlet 22 and the air intake 26 are respectively provided with large opening areas, the velocity of the exhaust flow can effectively be dampened when impinging against the inner surface of the air rectifying duct 25, and as a result, the noise caused by the impinging exhaust can be satisfactorily suppressed, and then the exhaust can be smoothly routed to the left and right passages before eventually being discharged outside.

The present invention thus described above in reference to the annexed drawings may be well suggestive of or modifications from the details described therein by those skilled in the art. It should be understood, however, that the present invention is not merely limited to the details described above, but is intended to include all of such modifications within the spirit and scope of the following claims.

What is claimed is:

1. A cleaner comprising:

a housing;

an air blower within said housing for drawing air and accompanying particles into said housing, and filter means for removing particles from said air;

exhaust means for receiving air from said blower and for exhausting said air from said cleaner with a minimum of noise;

said exhaust means comprising an inlet portion adjacent one end of said housing for receiving said air from said blower, a plurality of outlet portions adjacent an opposite end of said housing for exhausting said air received by said inlet portion, and a plurality of air rectifying duct portions extending in a substantially linear manner for at least substantially the length of said housing from said inlet portion at said one end to said respective outlet portions at said opposite end, each air rectifying duct portion receiving a portion of said air received by said inlet portion of said exhaust means;

noise absorbing means within the inlet portion of said exhaust means where the air from the blower impinges against said exhaust means; and noise shielding means across each outlet portion of the exhaust means.

2. The cleaner of claim 1, wherein each said noise shielding means also extends over a part of said respective duct portion adjacent said respective outlet portion for further reducing noise adjacent said outlet portion.

3. The cleaner according to claim 1 wherein:

the noise shielding means at each outlet portion extends across the exhaust outlet portion and across a portion of the air rectifying duct portion adjacent said outlet upon which air in said duct portion impinges.

4. The cleaner according to claim 1, further comprising:

a soft cover covering the surface of the air rectifying duct portions.

5. The cleaner according to claim 1 wherein the area of the inlet portion of the exhaust means is greater than the area of the exhaust passage of each air rectifying duct portion.

6. The cleaner of claim 1, wherein said exhaust means reduces the velocity of air flowing through said cleaner for reducing the noise emitted by said exhaust means.

7. The cleaner of claim 1, wherein said inlet portion of said exhaust means is adjacent a rear portion of said housing and two outlet portions of said exhaust means are located adjacent a front portion of said housing.

8. The cleaner of claim 1, wherein said air rectifying duct portions extend at least along side surfaces of said housing.

9. The cleaner of claim 1, wherein said air rectifying duct portions extend along the rear surface of said housing and along both side surfaces thereof.

10. The cleaner of claim 1, wherein said plurality of air rectifying duct portions are adjacent to the exterior surface of said housing.

* * * * *